US008911167B2

(12) United States Patent
Kanazawa et al.

(10) Patent No.: US 8,911,167 B2
(45) Date of Patent: Dec. 16, 2014

(54) SHEET CUTTING DEVICE AND PRINTER

(71) Applicant: Canon Kabushiki Kaisha, Tokyo (JP)

(72) Inventors: Manabu Kanazawa, Yokohama (JP); Masahito Yoshida, Shiki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/655,175

(22) Filed: Oct. 18, 2012

(65) Prior Publication Data

US 2013/0101329 A1 Apr. 25, 2013

(30) Foreign Application Priority Data

Oct. 21, 2011 (JP) ..... 2011-232042

(51) Int. Cl.

| | |
|---|---|
| ***B41J 11/44*** | (2006.01) |
| ***B26D 7/06*** | (2006.01) |
| ***B65H 29/26*** | (2006.01) |
| ***B41J 11/00*** | (2006.01) |
| ***B41J 11/70*** | (2006.01) |
| ***B26D 5/18*** | (2006.01) |
| ***B26D 7/32*** | (2006.01) |
| ***B65H 35/06*** | (2006.01) |
| *B26D 7/00* | (2006.01) |

(52) U.S. Cl.

CPC ..... *B65H 35/06* (2013.01); *B26D 2007/005* (2013.01); *B65H 29/26* (2013.01); *B65H 2301/543* (2013.01); *B41J 11/007* (2013.01); *B41J 11/70* (2013.01); *B26D 5/18* (2013.01); *B65H 2801/27* (2013.01); *B26D 7/32* (2013.01); *B65H 2301/342* (2013.01)

USPC ..... 400/621; 400/76; 83/102; 83/155

(58) Field of Classification Search

CPC ..... B41J 11/66; B41J 11/70; B41J 11/663; B26D 7/18; B26D 7/1854; B26D 7/1863; B26D 2007/18

USPC ..... 400/621

See application file for complete search history.

(56) References Cited

U.S. PATENT DOCUMENTS

| | | | | |
|---|---|---|---|---|
| 5,398,919 | A * | 3/1995 | Suter | 270/58.02 |
| 6,260,457 | B1 * | 7/2001 | Hakkaku | 83/167 |
| 7,407,155 | B2 * | 8/2008 | Tamura et al. | 270/58.07 |
| 8,011,282 | B2 * | 9/2011 | Yoshimaru | 83/100 |
| 2001/0054342 | A1 * | 12/2001 | Kato et al. | 83/78 |
| 2008/0111299 | A1 * | 5/2008 | Sato | 271/278 |

FOREIGN PATENT DOCUMENTS

| | | |
|---|---|---|
| JP | 2003-237157 A | 8/2003 |

* cited by examiner

*Primary Examiner* — Jill Culler
*Assistant Examiner* — Justin Olamit
(74) *Attorney, Agent, or Firm* — Canon U.S.A., Inc., IP Division

(57) ABSTRACT

A sheet cutting device includes a conveyance unit configured to convey a sheet, a cutting unit configured to cut the sheet conveyed by the conveyance unit, and a conveyance belt configured to convey a cut piece cut from the sheet cut by the cutting unit in a direction orthogonal to a conveyance direction of the conveyance unit.

10 Claims, 22 Drawing Sheets

SHEET CUTTING DEVICE AND PRINTER

BACKGROUND OF THE INVENTION

1. Field of the Invention

Aspects of the present invention relate to a sheet cutting unit and a separation unit capable of separating a finished product and a waste portion cut by the sheet cutting unit. The sheet cutting unit and the separation unit are included in an image forming apparatus configured to produce a single sheet print product in a target size by cutting off the waste portion on a tailing end in a conveyance direction from the sheet on which an image is formed.

2. Description of the Related Art

Conventionally, image forming apparatuses configured to produce a single sheet image-printed product can be roughly divided into the following categories: image forming apparatuses configured to form an image on a medium in a target size of a print product, and image forming apparatuses configured to form an image on a medium whose size is larger than a target size, and to produce a print product in the target size by cutting a waste portion therefrom.

The above described image forming apparatuses in the latter case in which the medium is cut after forming the image include large-scale image forming apparatuses capable of producing a single sheet finished product from a continuous sheet in a roll shape. In such a large-scale image forming apparatus, a sheet conveyance unit and a sheet cutting unit are installed, and a print product and a waste portion are separated inside the image forming apparatus.

In general, processing of cutting and separating a finished product (print product) and a waste portion is required to handle various sizes of the print products in the same image forming apparatus.

Japanese Patent Application Laid-Open No. 2003-237157 discusses a method for automatically cutting a waste portion of roll paper from a recording medium. In the method discussed in Japanese Patent Application Laid-Open No. 2003-237157, the waste portion cut by a cutting unit freely drops into a container (storage unit) located just below the cutting unit via a guiding path.

In Japanese Patent Application Laid-Open No. 2003-237157, because the storage unit collects the cut waste portion that drops freely, the degree of freedom in the arrangement of the storage unit may be limited. With this configuration, depending on an overall configuration of the image forming apparatus, the storage unit for the waste portion may not be located in a position that a user can easily access.

SUMMARY OF THE INVENTION

Aspects of the present invention relate to a technique to increase a degree of freedom in arrangement of a storage unit for storing a cut piece separated from a sheet, and to suppress conveyance failure of the cut piece from occurring.

According to an aspect of the present invention, a sheet cutting device includes a conveyance unit configured to convey a sheet, a cutting unit configured to cut the sheet conveyed by the conveyance unit, and a conveyance belt configured to convey the cut piece cut from the sheet cut by the cutting unit in a direction orthogonal to a conveyance direction of the conveyance unit.

According to exemplary embodiments the present invention, the degree of freedom in arrangement of the storage unit for storing the cut piece separated from the sheet can be increased, and the conveyance failure of the cut piece can be suppressed from occurring.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment according to the present invention embodied in an ink jet printer is described. A printer according to the present exemplary embodiment is a high-speed line printer which employs a continuous sheet wound into a roll shape. The high-speed line printer is suitable for large-volume printing performed in a print lab, for example.

Figure 1:
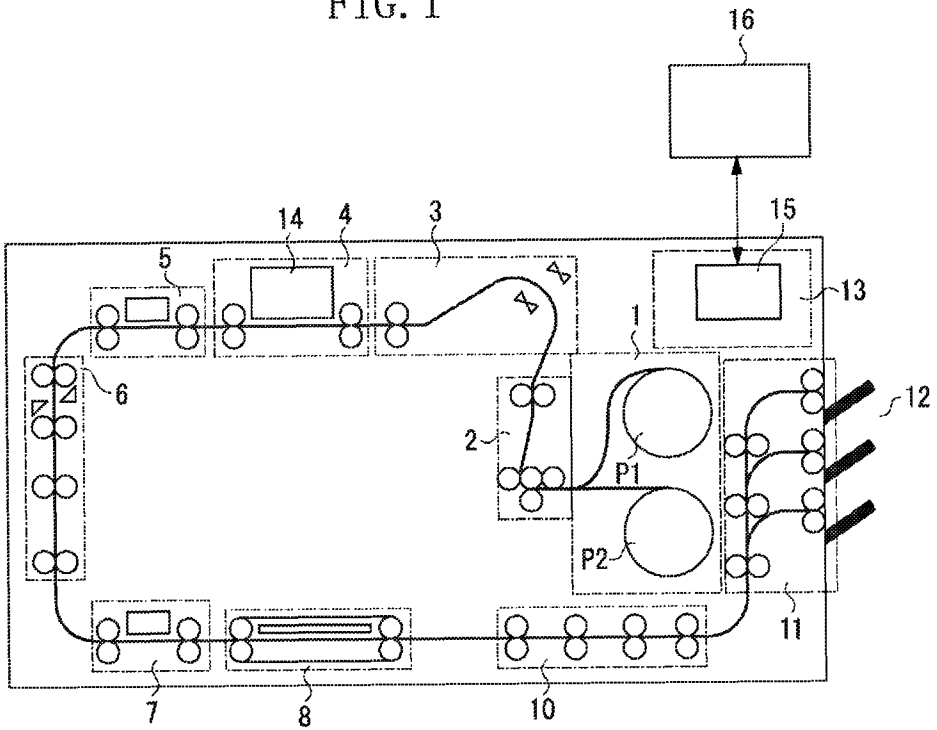
FIG. 1 is a cross-sectional diagram schematically illustrating an internal configuration of a printer including a sheet cutting device according to an exemplary embodiment.

FIG. 1 is a cross-sectional diagram schematically illustrating an internal configuration of a printer including a sheet trailing end cutting-separating mechanism according to the exemplary embodiment of the present invention.

Generally, the printer includes various units such as a sheet feeding unit 1, a decurling unit 2, a skew correction unit 3, a print unit 4, an inspection unit 5, a sheet cutting-conveying unit 6, an information recording unit 7, a drying unit 8, a discharge-conveyance unit 10, a sorting unit 11, a discharge tray 12, and a control unit 13. A sheet is conveyed along a conveyance path indicated by a solid line in FIG. 1 via a conveyance mechanism configured of roller pairs and belts, and processing is performed thereon by each unit.

The sheet feeding unit 1 stores and feeds a continuous sheet wound into a roll shape. The sheet feeding unit 1 can store two rolls P1 and P2, and is configured to selectively draw and feed the sheet from any one of the rolls P1 and P2. A number of rolls which can be stored in the sheet feeding unit 1 is not limited to two, and may be just one, or more than two.

The decurling unit 2 reduces a curl (curve) on the sheet that is fed from the sheet feeding unit 1. In the decurling unit 2, two pinch rollers are disposed with respect to one drive roller, and the sheet is curved and pressed by the pinch rollers in the reverse direction of the curl. Thus, the curl on the sheet can be reduced.

The skew correction unit 3 corrects a skewed state (a slant with respect to an original conveying direction) of the sheet which passes through the decurling unit 2. The skewed state of the sheet is corrected by pressing one edge portion of the sheet serving as a reference side against a guide member.

The print unit 4 causes a print head 14 to form an image on the sheet conveyed thereto. The print unit 4 also includes a plurality of conveyance rollers for conveying the sheet. The print head 14 includes a line type print head on which ink jet nozzle arrays are formed over a range that is capable of covering the maximum width of the sheet expected to be used in the printer. In the print head 14, a plurality of print heads disposed in parallel to the sheet conveyance direction. An ink jet method may include a method using a heating element, a piezoelectric element, an electrostatic element, a micro-electro mechanical system (MEMS) element, and the like. Ink of each color is supplied to the print head 14 from an ink tank via an ink tube respectively.

The inspection unit 5 optically reads an inspection pattern or an image which is printed on the sheet by the print unit 4, and inspects a nozzle status in the print head, a sheet conveyance status, a printing position of the image, and so on.

The sheet cutting-conveying unit 6 includes a mechanical cutter for cutting the sheet after printing into a predetermined length. The sheet cutting-conveying unit 6 also includes a plurality of conveyance rollers for conveying each sheet to the next processing, and a space for storing waste portions generated through a cutting operation. In addition, a sheet trailing end cutting-separating mechanism according to the present exemplary embodiment is included in the sheet cutting-conveying unit 6.

The drying unit 8 heats the sheet printed by the print unit 4, and dries the applied ink within a short period of time. The drying unit 8 includes a heater, and a conveyance belt and conveyance rollers for conveying the sheet to the next processing.

When the sheet has been cut by the sheet cutting-conveying unit 6 and dried by the drying unit 8, the discharge-conveyance unit 10 conveys and transfers the sheet to the sorting unit 11. The sorting unit 11 sorts each of the printed sheets into groups, and discharges the sheets to the respective discharge trays 12 when necessary.

The control unit 13 controls operations of each unit in the printer. The control unit 13 includes a central processing unit (CPU) 601, a memory, a controller 15 which includes various input/output (I/O) interfaces, and a power source. Operations of the printer are controlled based on instructions issued from the controller 15 or an external device 16 such as a host computer connected to the controller 15 via the I/O interface.

Figure 2:
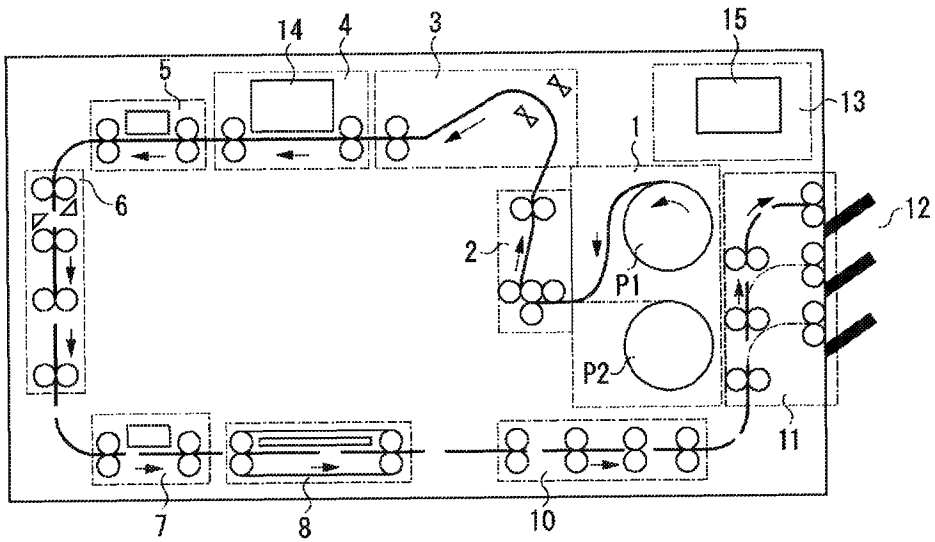
FIG. 2 is a schematic diagram illustrating operations of the printer including the sheet cutting device according to the exemplary embodiment.

FIG. 2 is a schematic diagram illustrating operations of the printer which includes the sheet trailing end cutting-separating mechanism according to the exemplary embodiment of the present invention.

A conveyance path in which a sheet fed from the sheet feeding unit 1 is printed and discharged to the discharge tray 12 is indicated by a bold line. The sheet fed from the sheet feeding unit 1 undergoes the processing performed by the decurling unit 2 and the skew correction unit 3. Then, printing is performed on a surface of the sheet by the print unit 4. The printed sheet passes the inspection unit 5, and is cut into cut sheets in a predetermined unit length, which is set in advance, by the sheet cutting-conveying unit 6. Each of the cut sheets is conveyed to the drying unit 8 one by one for drying processing. Then, the cut sheet is sequentially discharged and piled up onto the discharge tray 12 of the sorting unit 11 via the discharge-conveyance unit 10.

The sheet cutting-conveying unit 6 including the sheet trailing end cutting-separating mechanism according to the present exemplary embodiment, which is embodied in the printer in the above described configuration, is described further.

Figure 3:
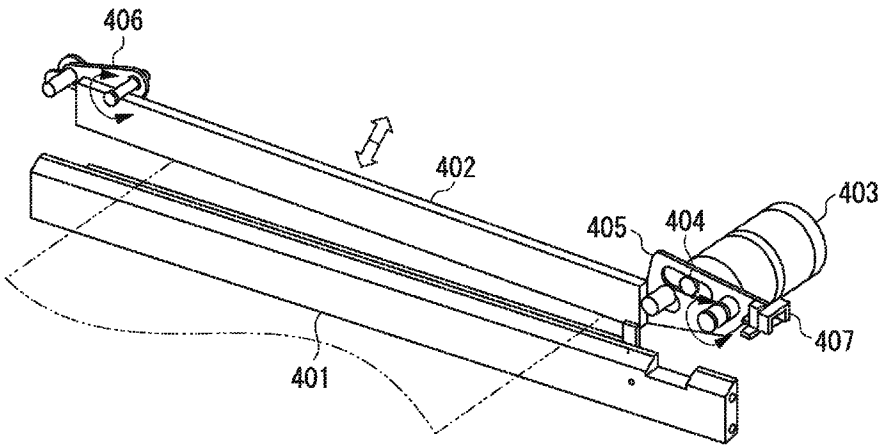
FIG. 3 is a schematic diagram illustrating a configuration of a cutter disposed in the sheet cutting device according to the exemplary embodiment.

FIG. 3 is a schematic diagram illustrating a configuration of the cutter included in the sheet cutting-conveying unit 6. In general, the cutter is a slide type cutter, and is configured of a fixed blade 401 and a movable blade 402. The movable blade 402 is driven by a cutter-driving motor 403 serving as a cutter driving source, and moves up and down while obliquely contacting with the fixed blade 401 via a cam 404, a drive-side link 405, and a driven-side link 406. During the normal conveyance, the sheet is guided to a position between the two cutter blades where the movable blade 402 is moved to an uppermost position farthest from the fixed blade 402 (i.e., top dead center), and the sheet is completely cut when the movable blade 402 is moved to the lowest position (i.e., bottom dead center). Because the load applied during the cutting processing varies significantly according to the condition of a recording medium or the like, a direct-current (DC) motor is employed for the cutter-driving motor 403. A cutter sensor 407 detects the position of the movable blade 402, and stops the movable blade 402 by directly connecting both terminals of the DC motor (i.e., short brake) according to the detection timing. Thus, high-speed movement stopping control can be realized. In general, the cutter sensor 407 is disposed to cause the movable blade 402 to stop at the top dead center. If the movable blade 402 may stop at the bottom dead center, a similar type of sensor can be added.

Figure 4:
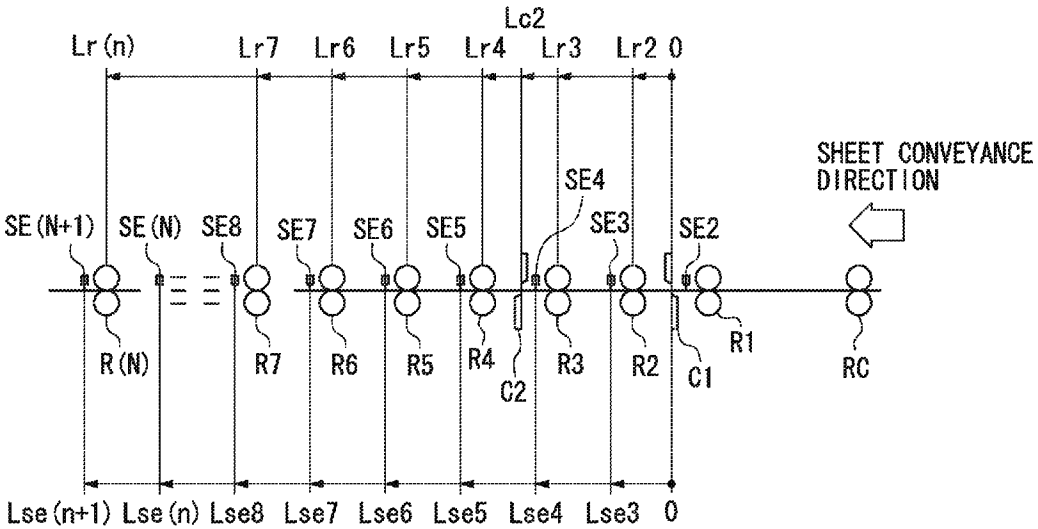
FIG. 4 is a schematic diagram illustrating a configuration of a sheet cutting-conveying unit according to the exemplary embodiment.

FIG. 4 is a schematic diagram illustrating a configuration of the sheet cutting-conveying unit 6 including the sheet trailing end cutting-separating mechanism according to a first exemplary embodiment of the present invention. A sheet is conveyed from right to left as indicated by a block arrow in FIG. 4. The cutting-conveying unit 6 includes two sets of cutters, a first cutter C1 and a second cutter C2, serving as cutting units. Each of the cutting units is a slide type cutter configured of a fixed blade and a movable blade. Each cutting unit cuts the continuous sheet in a sheet width direction. Conveyance roller pairs which are disposed along the conveyance direction serve as a sheet conveyance unit. Each of the conveyance roller pairs is configured of a drive roller and a driven roller which rotates freely by being pressed and contacting with the drive roller. Each of the drive rollers rotates by receiving a moving force from a motor (not shown). Each conveyance roller pair is disposed at intervals slightly shorter than a length of a print product that can be conveyed by the printer. A sheet of paper whose length is shorter than the interval between the conveyance roller pairs is considered as an off-specification sheet because it cannot be conveyed by the conveyance unit. A sheet guiding member serving as a conveyance auxiliary unit is disposed between the conveyance roller pairs. However, the sheet guiding member is not illustrated in FIG. 4 because it is not required for the description of the present exemplary embodiment.

A conveyance roller pair RC disposed in the most upstream side in the conveyance direction conveys the continuous sheet to the first cutter C1 at a constant speed. The speed of the conveyance roller pair RC does not change corresponding to the cutting operation of the first cutter C1. Therefore, the conveyance roller pair RC may be included in the inspection unit 5 in the preceding processing rather than to be included in the sheet cutting-conveying unit 6. A conveyance roller pair R1 is disposed on the upstream side of the first cutter C1. Conveyance roller pairs R2 and R3 are disposed between the first cutter C1 and the second cutter C2. Further, conveyance roller pairs R4, R5, R6, and R7 are disposed on the downstream side of the second cutter C2. Edge sensors SE2, SE3, SE4, SE5, SE6, and SE7 are disposed on the respective upstream sides of the conveyance roller pairs R2, R3, R4, R5, R6, and R7. The edge sensors SE2 through SE7 can detect the leading edge or the trailing edge of the sheet conveyed therethrough. An edge sensor SE (N) and a conveyance roller pair R (N) may be additionally disposed on the downstream side if a sheet shape print product to be cut and conveyed becomes longer in size.

Figure 5:
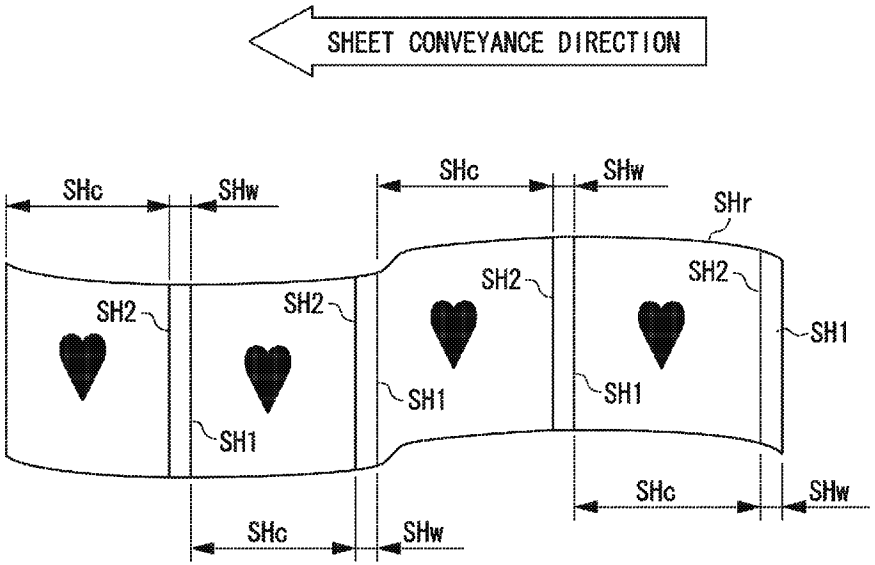
FIG. 5 illustrates an example of image formation performed on an uncut continuous sheet corresponding to the sheet cutting-conveying unit in FIG. 4.

FIG. 5 illustrates an example of image formation performed on the uncut continuous sheet which is conveyed to the sheet cutting-conveying mechanism in FIG. 4 after the images are formed by the print unit 4. A portion SHc and a waste portion SHw are printed on an uncut continuous sheet SHr in an alternate manner. The portion SHc becomes a finished print product when it is cut off from the uncut continuous sheet SHr. The portion SHc and the waste portion SHw are separated by the first cutter C1 and the second cutter C2. The waste portion SHw is necessary when the print product SHc is produced. A cut mark which precisely specifies a cutting position is printed on the waste portion SHw. In addition, portions of the printed image running off from the print product SHc when borderless printing without margin is performed, a pattern used for a print head maintenance, and the like are printed on the waste portion SHw. According to images printed thereon, the length of the waste portion SHw may vary from several millimeters to the length equivalent to that of the finished print product SHc. A leading end cutting position SH1 of the print product SHc is cut by the first cutter C1, whereas a trailing end cutting position SH2 of the print product SHc is cut by the second cutter C2. The waste portion SHw is separated by the second cutter C2.

FIGS. 6A through 6D and FIGS. 7A through 7D are schematic diagrams sequentially illustrating a cutting and conveying operation performed on the continuous sheet SHr by the sheet cutting-conveying mechanism in FIG. 4 to produce the print product SHc.

Figure 6A:
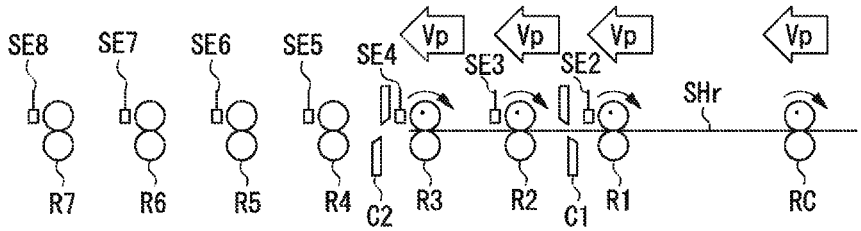
FIGS. 6A through 6D are schematic diagrams illustrating operations for cutting and conveying a sheet performed by the sheet cutting-conveying unit in FIG. 4.

FIG. 6A illustrates a state in which the printed sheet SHr reaches a cutting position. The uncut continuous sheet SHr consecutively conveyed from the upstream at a conveyance speed Vp passes through the conveyance roller pairs R1, R2, and R3 to reach the cutting position. The conveyance roller pairs R1 through R3 are disposed on the upstream side and the downstream side of the first cutter C1, and operate at the same conveyance speed Vp. In order to determine the cutting position, for example, the leading end of the sheet SHr that has passed through the conveyance roller pair R1 is detected by the edge sensor SE2, and based on a conveyance amount of the conveyance roller pair R1 after detection of the leading end, the length of the sheet SHr that has passed between the cutter blades, namely the cutting position can be determined. In addition, the cutting position may be determined by detecting the image formed on the sheet by an image sensor employed aside from the edge sensor SE2.

Figure 6B:
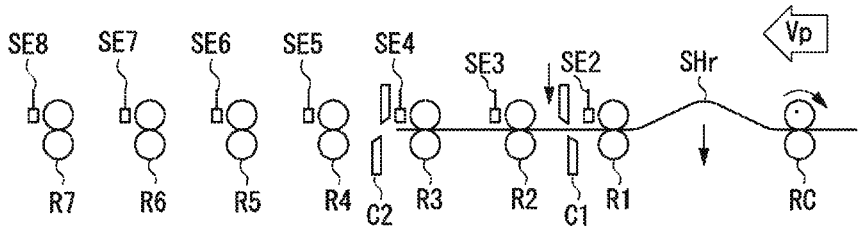

FIG. 6B illustrates a state in which the cutting position SH1 is cut by the first cutter C1. The conveyance roller pairs R1, R2, and R3, that pinch the continuous sheet SHr stop moving, and hold the continuous sheet SHr when the first cutter C1 performs a cutting operation. The uncut continuous sheet SHr on which the images are printed is consecutively conveyed from the upstream while the sheet is stopped at the first cutter C1. Thus, the uncut continuous sheet Shr is accumulated in the upstream side of the conveyance roller pair R1 in a loop-like manner.

Figure 6C:
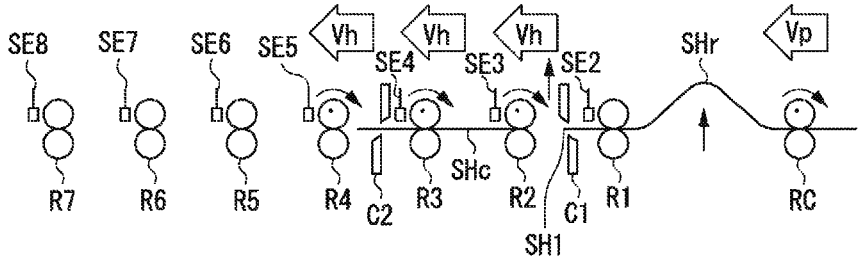

FIG. 6C illustrates a state immediately after the completion of cutting operation performed by the first cutter C1. When the cutting operation is completed, the cut print product SHc is conveyed at a speed Vh that is faster than the conveyance speed Vp of the uncut continuous sheet SHr in order to clear the loop-like accumulation of the continuous sheet SHr and to prevent the uncut continuous sheet SHr from overlapping with the print product SHc. The conveyance roller pairs R2, R3, and R4 are driven at the conveyance speed Vh while the conveyance roller pair R1 on the side of the uncut continuous sheet SHr is stopped. Thus, the cut print product SHc with the waste portion SHw is conveyed to the cutting position SH2 of the second cutter C2.

Figure 6D:
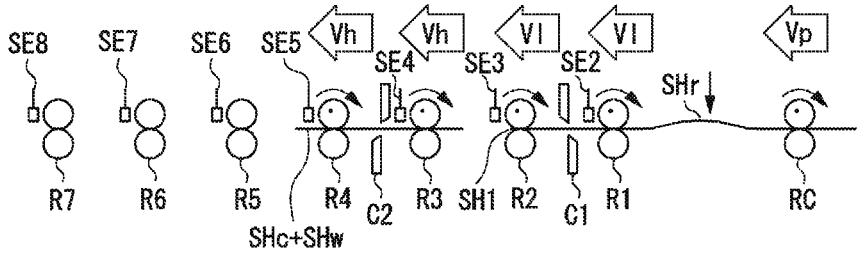

FIG. 6D illustrates a state slightly after the cut print product SHc with the waste portion SHw at the trailing end (i.e., SHc+SHw) has been conveyed at the conveyance speed Vh. In order to clear the loop of the continuous sheet SHr accumulated while the conveyance roller pair R1 has stopped, the conveyance roller pairs R1 and R2 cooperate with each other to convey the continuous sheet SHr by a specified length from the cutter for clearing the loop at the conveyance speed Vl. The conveyance speed Vl is faster than the conveyance speed Vp (Vl>Vp), and is capable of conveying the continuous sheet SHr without causing the leading end of the continuous sheet SHr to overlap with the cut print product SHc.

Figure 7A:
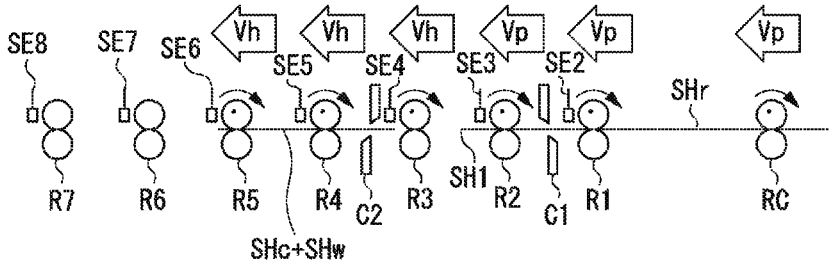
FIGS. 7A through 7D are schematic diagrams illustrating operations for cutting and conveying a sheet performed by the sheet cutting-conveying unit in FIG. 4.

FIG. 7A illustrates a state in which the print product SHc with the waste portion SHw (SHc+SHw) reaches the cutting position of the second cutter C2. After cutting by the first cutter C1, the leading end of the print product SHc conveyed at the conveyance speed Vh is detected by the edge sensor SE4. Then, the length of the print product SHc that has passed between the blades of the second cutter C2, namely the cutting position, can be determined from a rotation amount of the conveyance roller pair R4 rotated after detection of the leading end. In addition, the cutting position may be determined by detecting the image formed on the sheet by an image sensor employed aside from the edge sensor SE4 as in the case of the first cutter C1.

Figure 7B:
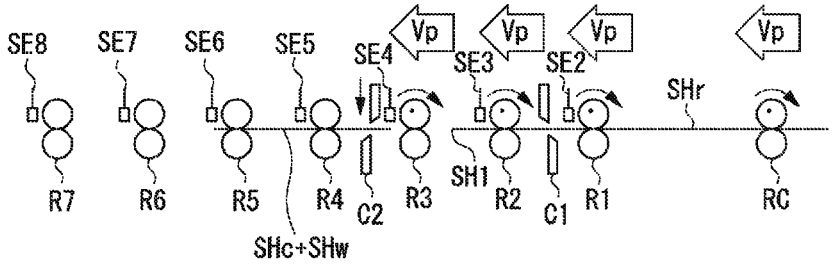

FIG. 7B illustrates a state in which the cutting position SH2 is cut by the second cutter C2. After the print product SHc with the waste portion SHw is cut by the first cutter C1, the conveyance roller pairs R4 and R5 in the downstream of the second cutter C2 pinch and suspend the print product SHc with the waste portion SHw when the cutting operation is performed by the second cutter C2. The waste portion SHw that is positioned on the upstream side of the second cutter C2 is separated by the cutting operation. The waste portion SHw is removed from the sheet conveyance path by means of a free-fall due to gravity and a flow of air.

Figure 7C:
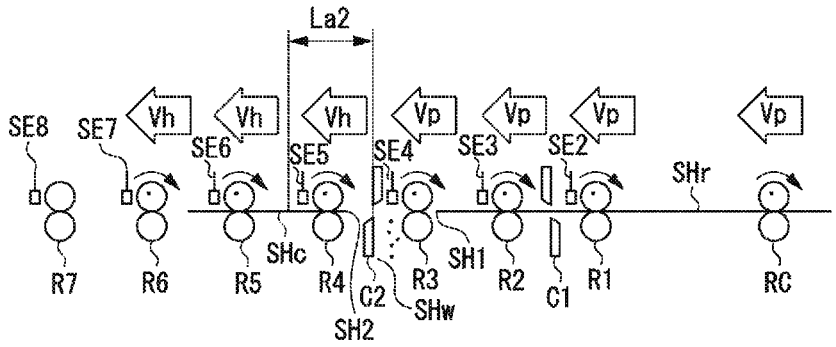

FIG. 7C illustrates a state immediately after the completion of the cutting operation performed by the second cutter C2. The print product SHc cut by the second cutter C2 is conveyed by the conveyance roller pairs R4, R5, and R6 by a specified length LA2 at the conveyance speed Vh that is faster than the conveyance speed Vp of the continuous sheet. Through this, the print product SHc is prevented from overlapping with the successive print product SHc that is cut by the first cutter C1 and conveyed from the upstream at the high-speed clearance speed Vh.

Figure 7D:
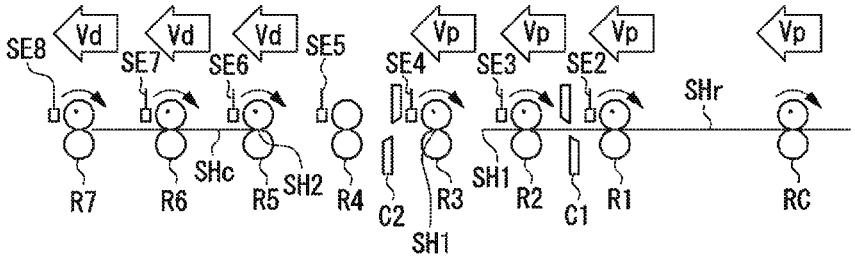

FIG. 7D illustrates a state continuing from the state illustrated in FIG. 7C. The print product SHc is conveyed by the conveyance roller pairs R5 and R6 at a speed Vd required for the drying unit 8. After the print product SHc is left from the conveyance roller pair R4, the conveyance roller pair R4 returns to the state illustrated in FIG. 6A, and repeats the conveying operation.

Figure 8:
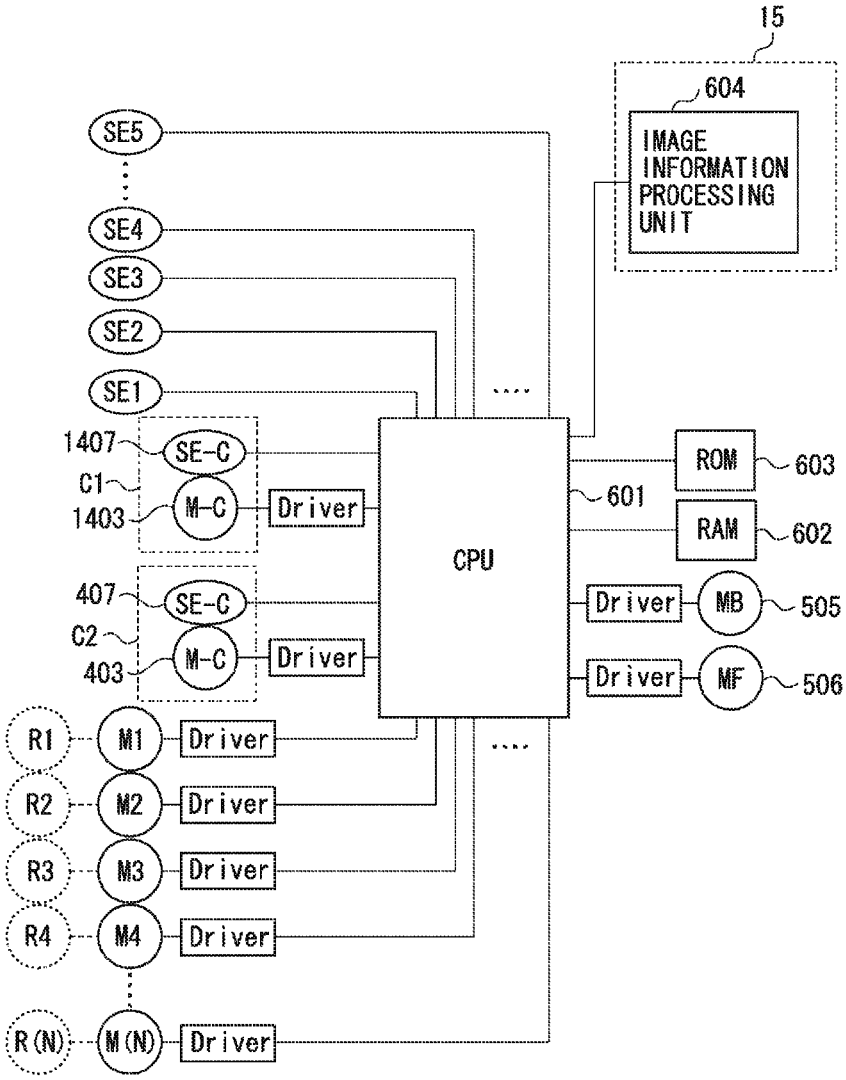
FIG. 8 is a block diagram illustrating a control configuration of the sheet cutting-conveying unit in FIG. 4.

FIG. 8 is a block diagram illustrating a control configuration of the sheet cutting-conveying mechanism according to the exemplary embodiment of the present invention. The output from the edge sensors SE2, SE3, and so on is input to the CPU 601. The CPU 601 controls motors M1, M2, M3, and so on via respective drivers, so as to cause the motors to drive the conveyance roller pairs R1, R2, R3, and so on, respectively. In addition, motors and sensors for other units, such as a cutter-driving motor 1403 and a cutter sensor 1407 included in a configuration of the first cutter C1, are also connected to the CPU 601, so that the operations thereof are controlled by the CPU 601. A control program to be executed by the CPU 601 is stored in a read only memory (ROM) 603, and data for the CPU 601 to control respective units is stored in a random access memory (RAM) 602. Of the control data, data for sheet lengths of cut products and data relating to cutting positions are input to the controller 15 from the external device 16, processed by an image information processing unit 604 of the controller 15, and input to the CPU 601.

The sheet trailing end cutting-separating mechanism according to the exemplary embodiment of the present invention relates to peripherals of the second cutter C2 for separating the waste portion from the print product. A cutter-driving motor 403 drives the second cutter C2, and a cutter sensor 407 serves as a sensor for the second cutter C2. A belt motor 505 drives a belt for conveying the cut waste portion. A fan motor 506 eliminates paper dust from the peripherals of the second cutter C2.

Figure 9:
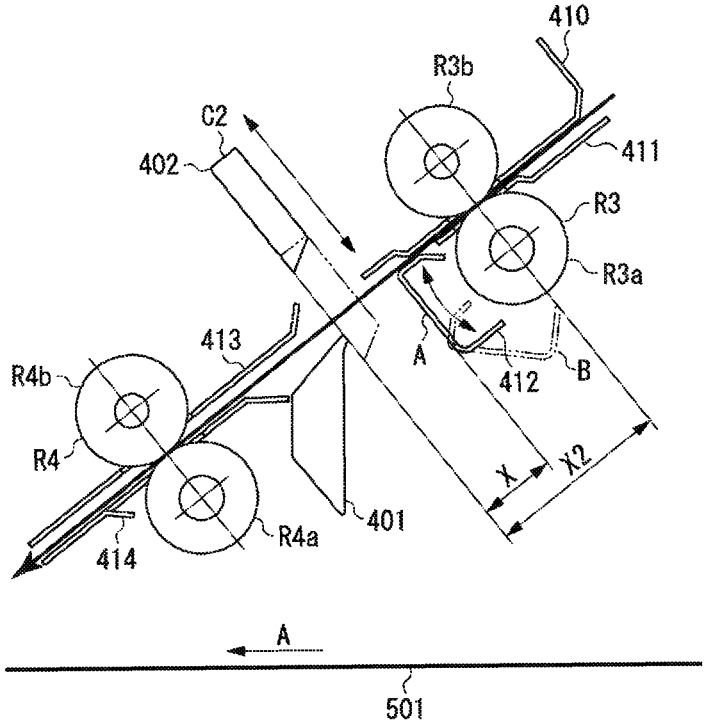
FIG. 9 is a cross-sectional diagram schematically illustrating principal portions of the sheet cutting-conveying unit.

FIG. 9 is a cross-sectional diagram schematically illustrating the peripherals of the second cutter C2 serving as the sheet trailing end cutting-separating mechanism according to the exemplary embodiment of the present invention.

The second cutter C2 includes the fixed blade 401 disposed on the downstream side in the conveyance direction, and the movable blade 402 disposed on the upstream side in the conveyance direction.

The sheet conveyance direction is a slanted, and a sheet is conveyed from the upper right side to the lower left side in FIG. 9. In the upstream side of the second cutter C2, the conveyance roller pair R3 including rollers R3*a* and R3*b* is disposed adjacent to the second cutter C2, and in the downstream side of the second cutter C2, the conveyance roller pair R4 including rollers R4*a* and R4*b* is disposed adjacent thereto. Between the roller pairs R3 and R4 and the second cutter C2, paper guides 410, 411, 412, 413, and 414 are disposed on the upstream and the downstream sides of the conveyance direction and on the upper and lower sides of the conveyance path, so as not to interfere with an operation area of the second cutter C2. A movable paper guide 412 disposed on the upstream and lower side of the conveyance path is driven by a driving source (not shown), and is movable between two positions A and B. Generally, the movable paper guide 412 stops at the position A.

The cutting-separating operation varies in the length of the waste portion SHw. A first length that is the shortest among the lengths of the waste portion SHw is shorter than a distance X between the leading end of the fixed blade 401 and the leading end of the movable paper guide 412 in the conveyance direction.

A second length of the waste portion SHw is a length in which a part of the waste portion SHw can be held by the conveyance unit on the upstream side when the waste portion SHw is cut by the second cutter C2. At this time, the length of the waste portion SHw which can be separated therefrom may be longer than a distance X2 between the leading end of the fixed blade 401 and a nip portion of the conveyance roller pair R3 in the conveyance direction, and the length thereof is adjusted as necessary when the image formation is performed.

Further, the second length is divided into a length that cannot be conveyed by the conveyance unit and a length that can be conveyed by the conveyance unit (i.e., a third length of the waste portion). The third length of the waste portion SHw that can be conveyed by the conveyance unit needs to be longer than the maximum distance between the adjacent conveyance roller pairs in the printer.

Figure 10A:
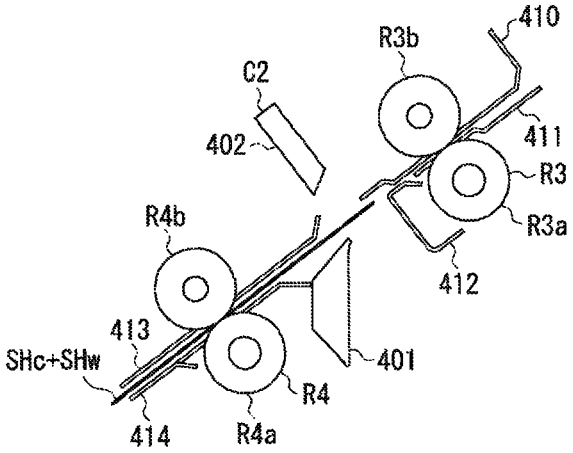
FIGS. 10A through 10C are schematic diagrams illustrating operations for cutting a waste portion of a continuous sheet when a length of the waste portion is short.
Figure 10B:
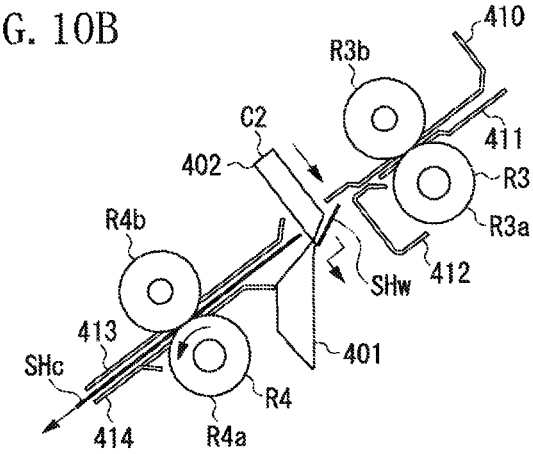
Figure 10C:
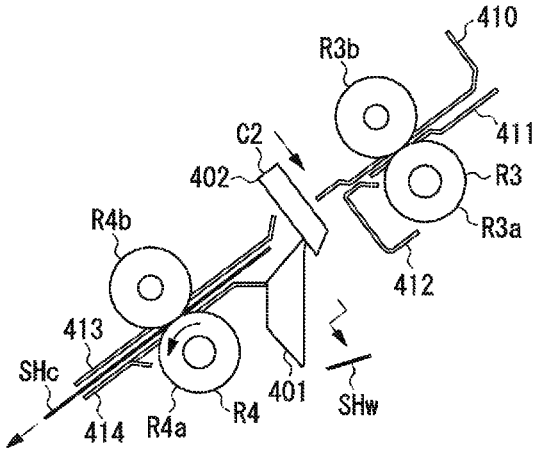

FIGS. 10A through 10C are schematic diagrams sequentially illustrating a state in which the sheet is cut and conveyed by the sheet trailing end cutting-separating mechanism according to the exemplary embodiment of the present invention when the waste portion SHw1 is the first length. The movable paper guide 412 stops at the position A. At this time, the length of the first waste portion SHw1 that can be separated from the print product SHc is shorter than the distance X between the leading end of the fixed blade 401 and the leading end of the movable blade 412 in the conveyance direction.

FIG. 10A illustrates a state in which the printed sheet is conveyed and reaches the cutting position. The cut print product SHc with the waste portion SHw1 is held and suspended by the conveyance roller pair R4, while the waste portion SHw1 is left on the rear side of the second cutter C2.

FIG. 10B illustrates a state of cutting the sheet. The sheet is cut by the movable blade 402 moving downward at the cutting position in the width direction. Then, the waste portion SHw1 is pushed downward by the movable blade 402. Even if the movable blade 402 has not completed one cycle of the cutting operation, the conveyance roller pair R4 can start conveyance of the print product SHc to the next processing at the timing when the waste portion SHw1 is completely cut off.

FIG. 10C illustrates a state of separating the waste portion SHw1. The waste portion SHw1 further drops downward a gap between the fixed blade 401 and the paper guide 412 due to gravity, and is removed from the sheet conveyance path.

FIGS. 11A through 11E are schematic diagrams sequentially illustrating a state in which the sheet is cut and conveyed by the sheet trailing end cutting-separating mechanism according to the exemplary embodiment of the present invention when the waste portion SHw2 is the second length.

Figure 11A:
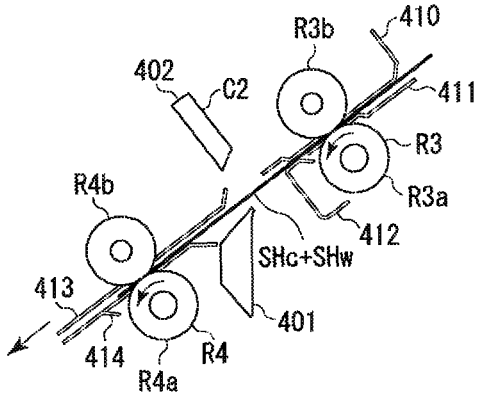
FIGS. 11A through 11E are schematic diagrams illustrating operations for cutting a waste portion of a continuous sheet when a length of the waste portion is long.

FIG. 11A illustrates a state in which the sheet is conveyed, and the leading end thereof is held by the conveyance roller pair R4 disposed on the downstream side of the second cutter C2. The movable paper guide 412 on the upstream and lower side of the conveyance path is maintained at the position A until the leading end of the sheet reaches the conveyance roller pair R4. The print product SHc with the waste portion SHw2 is further conveyed until reaching the cutting position.

Figure 11B:
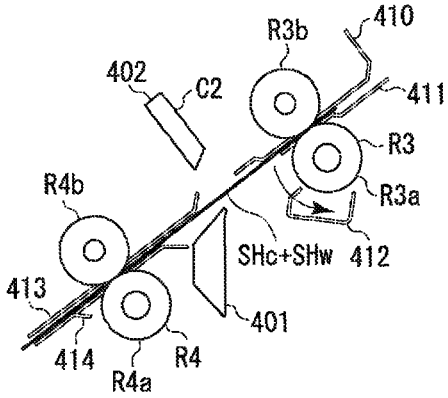

FIG. 11B illustrates a state in which the movable paper guide 412 on the upstream and lower side of the conveyance path moves to the position B, and the print product SHc with the waste portion SHw2 is conveyed and has reached the cutting unit. The movable paper guide 412 on the upstream and lower side of the conveyance path may move to the position B immediately after the state illustrated in FIG. 11A where the conveyance of the leading end of the sheet is supported by the movable paper guide 412.

Figure 11C:
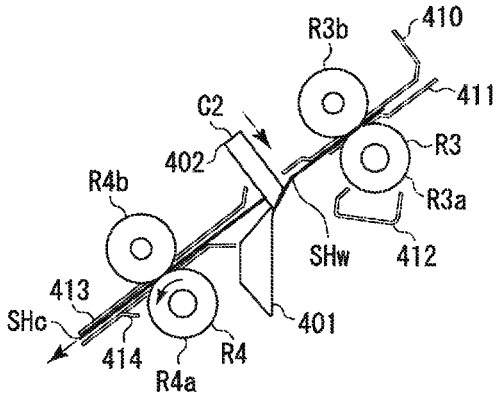

FIG. 11C illustrates a state of cutting the sheet. The print product SHc with the waste portion SHw2 is cut at the cutting position SH2 when the movable blade 402 moves downward, and the end portion of the waste portion SHw2 is pushed downward by the movable blade 402.

Figure 11D:
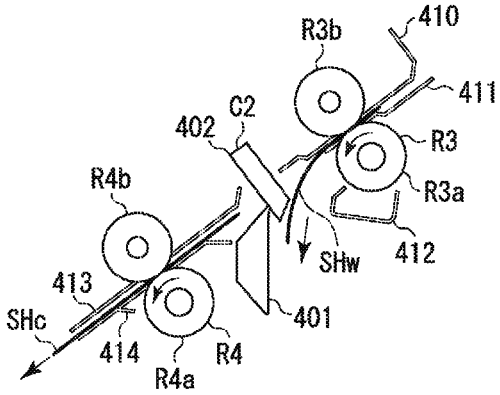

FIG. 11D illustrates a state in which the movable blade 402 reaches the bottom dead center, and the cutting operation is completed. At this time, the conveyance roller pair R3 starts driving, so that the waste portion SHw2 is guided by the vertical plane of the fixed blade 401, and discharged downward. In addition, the conveyance roller pair R4 may be driven at the same time to start conveyance of the print product SHc to the next processing.

Figure 11E:
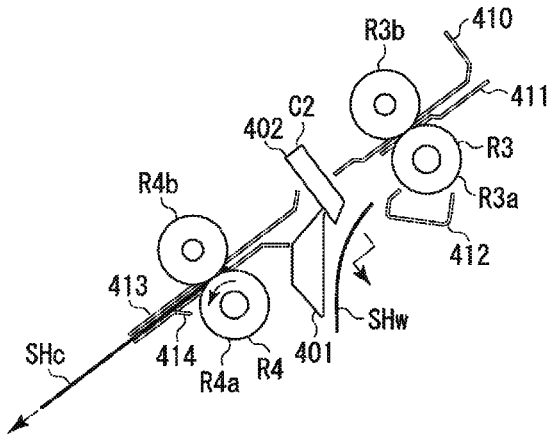

FIG. 11E illustrates a state in which the waste portion SHw2 has been completely discharged downward. The trailing end of the waste portion is separated from the conveyance roller pair R3 and the waste portion drops further downward away from the movable range of the movable paper guide 412. Then, the movable paper guide 412 on the upstream and lower side of the conveyance path returns to the position A, and repeats the similar operations from the state illustrated in FIG. 10A.

As described above, the waste portion SHw can be separated to the lower side when the length of the waste portion SHw is the second length. Depending on restriction of a separation-storing unit, the operations may be performed such that the movable paper guide 412 does not operate for the longest waste portion SHw in the third length, and the waste portion SHw is cut and conveyed in a same manner as the print product SHc. Accordingly, the waste portion SHw is separated by the sorting unit 11 located in the most downstream side.

Figure 12:
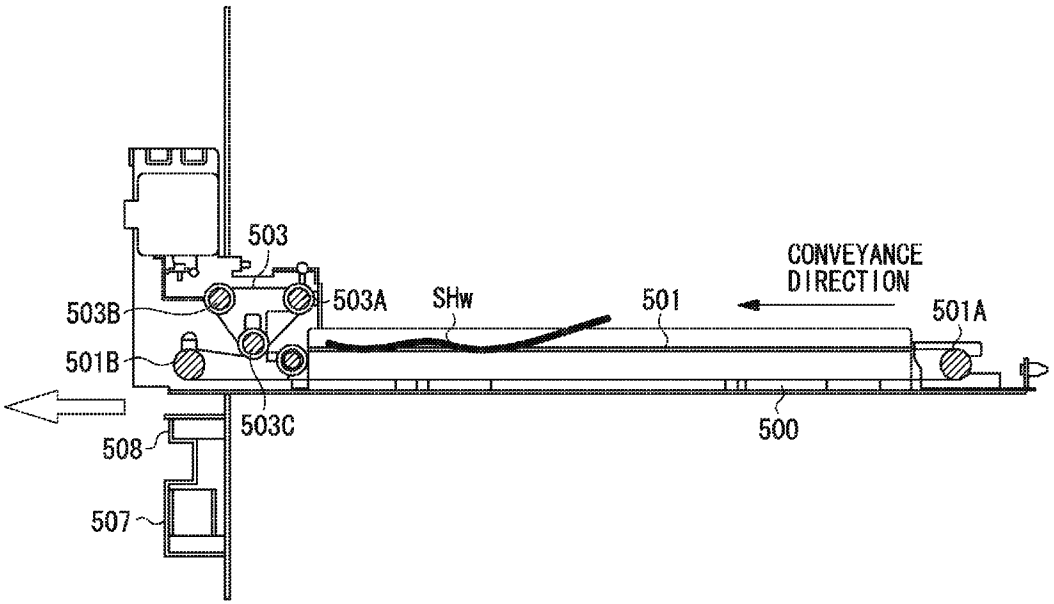
FIG. 12 is a cross-sectional diagram schematically illustrating a configuration of a conveyance belt.
Figure 13:
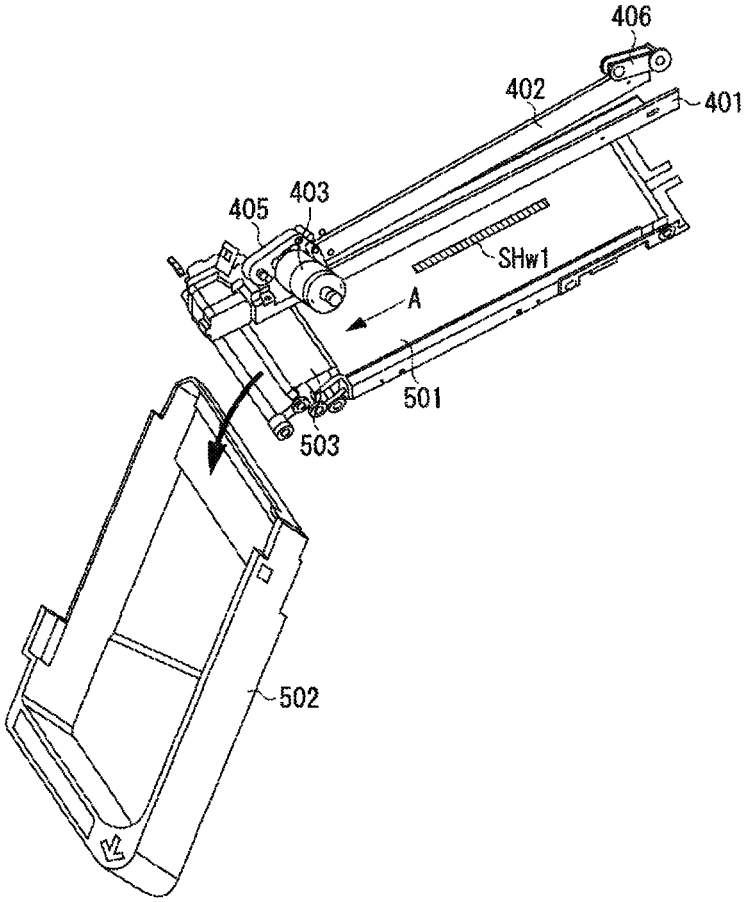
FIG. 13 is a perspective view illustrating an operation for cutting and conveying a continuous sheet when a length of the waste portion thereof is short.
Figure 14:
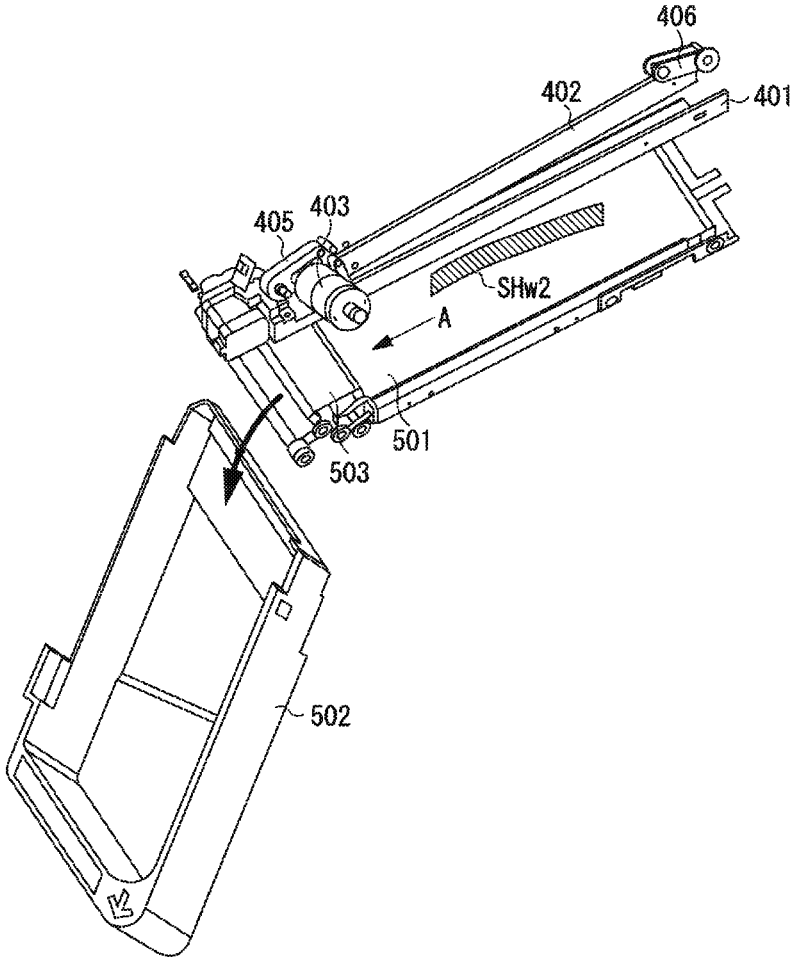
FIG. 14 is a perspective view illustrating an operation for cutting and conveying a continuous sheet when a length of the waste portion thereof is long.

Next, descriptions will be given to a unit for collecting the waste portion SHw which becomes a cut piece after being cut and separated from the print product SHc. In FIGS. 12, 13, and 14, a belt unit 500 includes a conveyance belt 501 which conveys a cut piece of the waste portion SHw from the cutting unit to a container 502, in a direction intersecting with (i.e., orthogonal to) the conveyance direction of the continuous sheet. The container 502 serves as a storage unit for storing the waste portion SHw. The conveyance belt 501 is supported by pulleys 501A and 501B, and driven by the drive pulley 501B which is rotated by the belt motor 505. A driven belt 503 is supported by pulleys 503A, 503B, and 503C which are disposed in a rotatable manner. The driven belt 503 is brought into contact with an end portion of the conveyance belt 501 on the downstream side to form a nip portion.

The waste portion SHw as a cut piece cut by the cutting unit drops on the conveyance belt 501 and is conveyed in a direction orthogonal to the conveyance direction of the continuous sheet indicated by an arrow. The waste portion SHw conveyed by the conveyance belt 501 is pinched between the conveyance belt 501 and the driven belt 503 that serves as a nipping member, and conveyed to the container 502. A duct 507 introduces the air discharged from a paper dust collecting fan (not shown) driven by the fan motor 506 to an exhaust opening 508. The flow of air discharged from the exhaust opening 508 in a block arrow direction prevents the waste portion SHw pinched by the nip portion between the conveyance belt 501 and the driven belt 503, from hanging downward excessively, and thus the waste portion SHw drops into the container 502 substantially in a horizontal posture when the trailing end thereof passes through the nip portion.

FIG. 13 illustrates a state in which the short waste portion SHw1 is discharged, and FIG. 14 illustrates a state in which the long waste portion SHw2 is discharged. The conveyance belt 501 is disposed to convey the waste portion SHw in a longitudinal direction thereof. When the waste portion SHw curls, the waste portion SHw may not lie down on the conveyance belt 501. Specifically, if the waste portion SHw2 stands on the conveyance belt 501, the waste portion SHw2 may not be pinched by the driven belt 503 due to its height and cause a paper jam.

Figure 15:
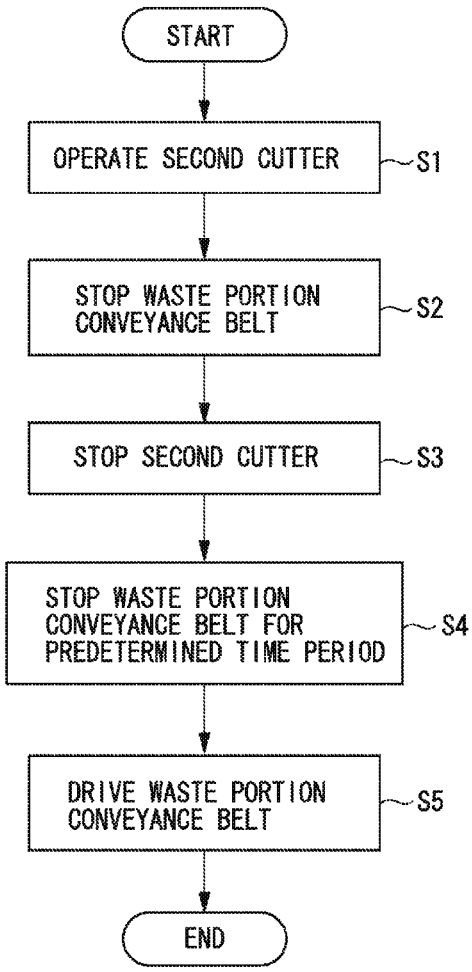
FIG. 15 is a flowchart illustrating a sequence for laying down a waste portion on a conveyance belt according to a first exemplary embodiment.

FIG. 15 is a flowchart illustrating a sequence for laying down the waste portion SHw on the conveyance belt 501 according to the first exemplary embodiment. In step S1, the second cutter C2 starts cutting the trailing end portion of the sheet. In step S2, the belt motor 505 is turned off to stop the conveyance belt 501.

In step S3, if the waste portion SHw is cut completely and the second cutter C2 stops, the waste portion SHw drops onto the conveyance belt 501. At this time, the waste portion SHw may lie down on the conveyance belt 501, or may not lie down but stand up due to its curled state. Driving the conveyance belt 501 while the waste portion SHw stands thereon may cause a paper jam when the waste portion SHw is conveyed onto the driven belt 503. The paper jam may happen remarkably when the long waste portion SHw2 is conveyed.

Therefore, in step S4, the conveyance belt 501 is suspended for a predetermined time period (for example, approximately 0.5 seconds) to gain some time for the dropped waste portion SHw to lie down. After passage of the predetermined time period sufficient for the waste portion SHw to lie down, in step S5, the conveyance belt 501 is driven, and the waste portion SHw is conveyed and disposed into the container 502.

As described above, providing the conveyance belt 501 increases the degree of freedom in the arrangement of the container 502 serving as a storage unit. In addition, when compared to the case where the conveyance belt 501 does not stop, stopping the conveyance belt 501 for a predetermined time period (approximately 0.5 seconds, for example) in step S4, and changing the state of the conveyance belt 501 from a stopped state to a driving state with the waste portion SHw placed thereon enables the waste portion SHw to lie down. By causing the waste portion to lie down, the conveyance failure can be prevented from occurring. The conveyance failure may include cases that the waste portion sticks out from the conveyance belt 501 and hits against other components, the waste portion drops from the conveyance belt 501, the waste portion causes the paper jam to occur, and so on.

Figure 16:
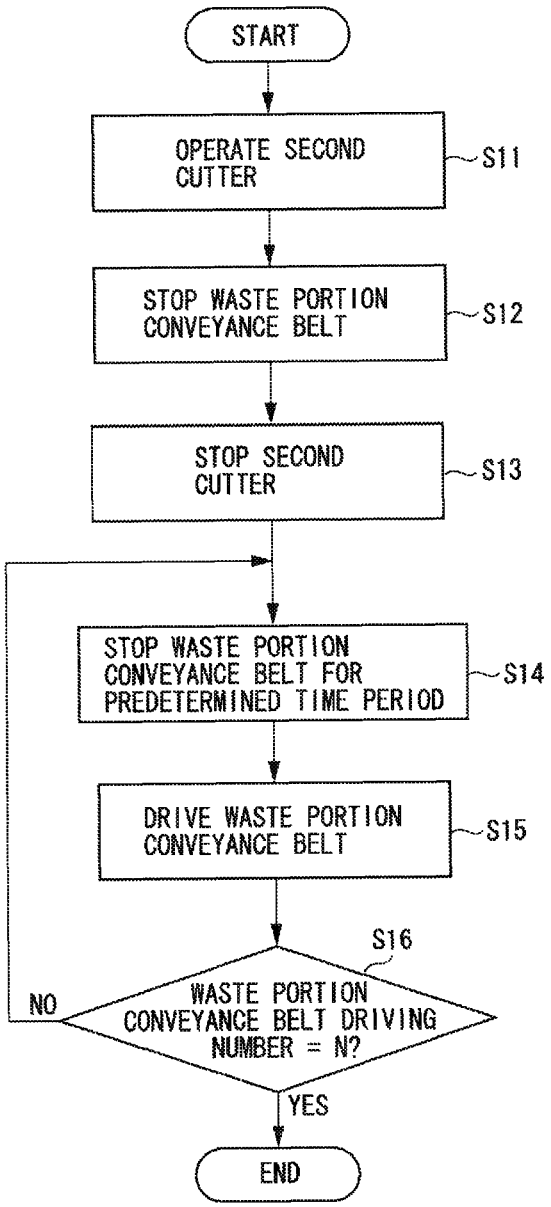
FIG. 16 is a flowchart illustrating a sequence for laying down a waste portion on a conveyance belt according to a second exemplary embodiment.

FIG. 16 is a flowchart illustrating an operational sequence according to a second exemplary embodiment. In step S11, the second cutter C2 starts cutting the trailing end portion of the sheet, and in step S12, the conveyance belt 501 stops. In step S13, when the second cutter C2 stops, the waste portion SHw is cut completely, and drops onto the conveyance belt 501.

In step S14, the conveyance belt 501 stops for a predetermined time period (for example, approximately 0.5 seconds). Then, in step S15, the conveyance belt 501 is driven after the waste portion SHw lies down. In step S16, it is determined whether the number of times of driving the conveyance belt 501 after stopping the second cutter C2 reaches a predetermined number "N".

If the number of driving times does not reach N times (NO in step S16), the processing returns to step S14, and repeats the processing in step S14 and S15 to stop and drive the conveyance belt 501 until the number of driving times reaches N times. If the number of driving times reaches N times (Yes in step S16), the conveyance belt 501 conveys the waste portion SHw to the container 502. The processing of repeatedly stopping and driving the conveyance belt 501 enables the conveyance belt 501 not only to gain some stoppage time but also to prompt the waste portion SHw to lie down easily by using the vibration caused by stopping and driving.

Figure 17:
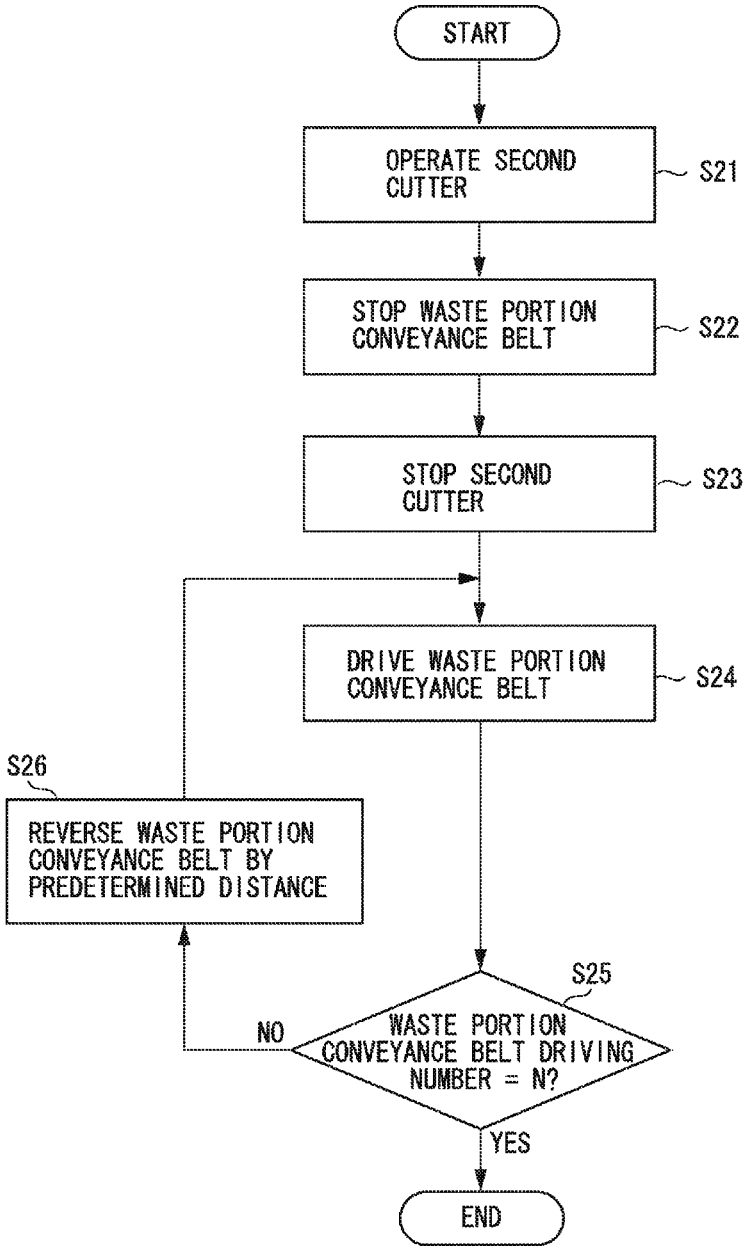
FIG. 17 is a flowchart illustrating a sequence for laying down a waste portion on a conveyance belt according to a third exemplary embodiment.

FIG. 17 is a flow chart illustrating a sequence for laying down the waste portion SHw on the conveyance belt 501 according to a third exemplary embodiment. In step S21, the second cutter C2 starts cutting the trailing end portion of the sheet, and in step S22, the conveyance belt 501 stops. In step S23, when the second cutter C2 stops, the waste portion SHw is cut completely and drops onto the conveyance belt 501.

In step S24, the conveyance belt 501 is driven in a normal rotation direction. Then in step S25, it is determined whether the number of normal rotation driving times of the conveyance belt 501 after stopping the second cutter C2 reaches a predetermined number "N". If the number of normal rotation driving times does not reach N times (NO in step S25), the processing proceeds to step S26. In step S26, the conveyance belt 501 is driven in a reverse rotation direction by a predetermined distance, and then, the processing returns to step S24. The processing of stopping, driving, and reverse driving the conveyance belt 501 is repeated until the number of driving times reaches the N times. When the number of driving times reaches the N times (YES in step S25), the conveyance belt 501 conveys the waste portion SHw to the container 502.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-232042 filed Oct. 21, 2011, which is hereby incorporated by reference herein in its entirety.

What is claimed is:

1. A sheet cutting device comprising:

a conveyance unit configured to convey a sheet;

a cutting unit configured to cut the sheet conveyed by the conveyance unit; and a conveyance belt configured to convey a waste portion cut from the sheet cut by the cutting unit; and a control unit configured to stop the conveyance belt until a predetermined time has elapsed after the cutting unit has stopped cutting the sheet, and then drive the conveyance belt to convey the waste portion after the predetermined time has elapsed.

2. The sheet cutting device according to claim 1, wherein the predetermined time is a time required for the waste portion to lie down on the conveyance belt.

3. The sheet cutting device according to claim 1, wherein the control unit is further configured to control the conveyance belt to move and stop repeatedly after the predetermined time has elapsed.

4. The sheet cutting device according to claim 1, further comprising a nipping member configured to cooperate with the conveyance belt to pinch the waste portion therebetween.

5. The sheet cutting device according to claim 1, wherein the conveyance belt is configured to convey the waste portion to a storage unit for storing the waste portion.

6. A printer comprising:

a print unit configured to form an image on a sheet; and a sheet cutting device according to claim 1 configured to cut the sheet on which the image is formed by the print unit.

7. A method for controlling a sheet cutting device, the method comprising:

conveying a sheet;

cutting the sheet conveyed; and stopping a conveyance belt until a predetermined time has elapsed after the cutting the sheet has stopped, and then driving the conveyance belt to convey with the conveying belt a waste portion cut from the sheet cut by the cutting after the predetermined time has elapsed.

8. The method according to claim 7, wherein the predetermined time is a time required for the waste portion to lie down on the conveyance belt.

9. The method according to claim 7, further comprising pinching the waste portion between a nipping member and the conveyance belt that conveys the waste portion.

10. The method according to claim 7, further comprising conveying the waste portion to a storage unit for storing the waste portion.

* * * * *